United States Patent [19]

Dysart

[11] Patent Number: 4,813,502

[45] Date of Patent: Mar. 21, 1989

[54] DRILLING BIT WITH IMPROVED TRAILING EDGE VENT

[75] Inventor: Theodore R. Dysart, Dallas, Tex.

[73] Assignee: Dresser Industries, Inc., Dallas, Tex.

[21] Appl. No.: 211,660

[22] Filed: Jun. 28, 1988

[51] Int. Cl.[4] ..... E21B 10/18; E21B 10/22

[52] U.S. Cl. ..... 175/337; 175/339

[58] Field of Search ..... 175/337, 339, 371, 372; 384/92, 93, 95

[56] References Cited

U.S. PATENT DOCUMENTS

| | | | |
|---|---|---|---|
| 3,534,823 | 10/1970 | Frederick | 175/337 |
| 3,921,735 | 11/1975 | Dysart | 175/337 |
| 4,193,463 | 3/1980 | Evans | 175/337 |
| 4,375,242 | 3/1983 | Galle | 175/339 X |
| 4,386,668 | 6/1983 | Parish | 175/228 |
| 4,421,184 | 12/1983 | Mullins | 175/337 |
| 4,515,228 | 5/1985 | Dolezal et al. | 175/339 X |
| 4,516,640 | 5/1985 | Karlsson | 175/227 |
| 4,688,651 | 8/1987 | Dysart | 175/371 |

*Primary Examiner*—Stephen J. Novosad
*Attorney, Agent, or Firm*—Edward G. Fiorito

[57] ABSTRACT

A rotating drill bit (10) includes a leg (12) and journal arm (14) on which is mounted a cone-shaped cutter (16). The cutter (14) rotates on the journal arm (14) by means of an anti-friction bearing including rollers (20) and ball bearings (26). Air is pumped through the journal arm (14) through conduits (30, 32 and 34). Air flows through the passages between rollers (20) and is collected in a cavity (52). The cavity (52) is vented to the borehole through a slot (54) in the trailing edge of the journal arm (14). A very narrow clearance in the order of a few thousandths of an inch is provided for rotational movement between the cone mouth shoulder (36) and last machined surface (40). Cone mouth shoulder (36) completely covers the last machined surface (40) around the entire periphery of the journal arm (14) except for the approximately 45° slot (54) in the trailing edge of the journal arm (14).

9 Claims, 2 Drawing Sheets

DRILLING BIT WITH IMPROVED TRAILING EDGE VENT

TECHNICAL FIELD

The present invention relates to the art of earth boring bits of the rotary type that utilize gaseous drilling fluid pumped through its bearings for cooling.

BACKGROUND ART

Conventional rotating bits used for drilling mining blast holes or geothermal wells normally employ three cone-shaped rolling cutters mounted on a journal arm or spindle. The cutters are mounted on the journal arm for rotational movement using rollers and balls to produce an anti-friction bearing. The drill bit is rotated by a drill string and a heavy load is brought to bear upon the cutters which rotate at the bottom of the borehole producing chips and other debris.

In order to cool the anti-friction bearings, air is pumped down the drill string through the journal arms into the anti-friction bearings. The air flows through the passageways between the rollers and out of the mouth of the cone-shaped cutters. Some provision must be made to allow the air to escape from the mouth of the cutter to the borehole while at the same time avoiding the incursion of borehole cuttings and other debris into the anti-friction bearing. Should such incursion take place, the bearings will wear prematurely and the useful life of the bit will be reduced.

In U.S. Pat. No. 3,921,735, issued to me on Nov. 25, 1975 entitled "Rotary Rock Bit With Cone Mouth Air Screen" assigned to Dresser Industries, Inc., a drill bit is described which provides a clearance between the shoulder of the cone mouth and the journal arm which is large enough to permit air to escape to the borehole. The clearance extends around the entire circumference of the journal arm so that air passing through all of the passages between the rollers escapes around the entire periphery of the cone mouth. In order to provide a barrier to the cuttings and other debris from entering the anti-friction bearings, a screen was inserted into the clearance between the cone mouth and the journal arm which allows the passage of air, but blocks the cuttings. The useful life of the screen material in this case becomes one of the determinative factors in the useful life of the bit, since failure of the screen will allow incursion of cuttings and debris through the entire circumference of the cone mouth clearance.

In another U.S. Pat. No. 4,688,651 issued to me on Aug. 25, 1987 entitled "Cone Mouth Debris Exclusion Shield" assigned to Dresser Industries, Inc., another air vent is disclosed. Once again a clearance is provided between the cone mouth and the journal arm around the entire circumference of the cutter and journal arm. In the upper or dome region of the bit a shield is inserted into the clearance between the cone mouth and journal arm. This shield, which is in the form a spring steel element, closes off the clearance between the cutter mouth and journal arm in the dome region of the bit causing the air to be vented out of the bottom half or shirttail region of the bit. The shield adds an additional component to the bit and additional manufacturing operations for mounting the shield.

Another U.S. Pat. No. 4,421,184 issued on Dec. 20, 1983 to John M. Mullins entitled "Rock Bit With Improved Shirttail Ventilation", assigned to Hughes Tool Company discloses a rock bit with a clearance between the cone mouth and journal arm which allows some air to be discharged in the dome region of the bit, but most of the air is discharged through a slot formed in the shirttail region of the bit. The slot exposes the passageways between the rollers, and the rollers themselves to direct view from the borehole.

Another commonly used air vent for a drilling bit is disclosed below in the Detailed Description Of The Drawings. In this bit a narrow clearance is established between the shoulder of the cutter cone mouth and a surface of the journal arm called the last machined surface, which is the surface on the journal arm formed during the last machining operation and closest to the region where the journal arm joins the leg of the bit. This clearance is narrow and substantially blocks the venting of air from the cone mouth. A groove is cut near the dome region of the bit into the last machined surface. The width of the groove is sufficient to reach the raceway in which the rollers travel thereby opening a number of passageways between the rollers for venting around the cone mouth into the borehole. This form of vent allows most of the cone mouth and last machined surface of the journal arm to block off the incursion of borehole cuttings and other debris into the anti-friction bearings. However, due to the location of the vent near the dome area, the bit cuttings and debris can plug or clog a portion of the air vent reducing the amount of cooling air, and also permit cuttings and debris to drop into the groove and enter the anti-friction bearings.

SUMMARY OF THE INVENTION

In this invention a novel vent is constructed which permits air to be exhausted from the anti-friction bearings while at the same time minimizing the incursion of borehole cuttings and debris into the anti-friction bearings. A semi-arcuate cavity is formed in the last machined surface of the journal arm near the dome area of the bit. The width of the semi-arcuate cavity is selected so that it leaves a portion of the last machined surface along the outer periphery of the journal arm intact and able therefore to match with the shoulder of the cutter cone mouth. The clearance between the last machined surface and the shoulder of the cutter cone mouth is small in the order of a few thousandths of an inch so that air does not exhaust through the clearance and incursion of borehole cuttings and debris into the anti-friction bearings is inhibited. The width of the cavity is also selected so that a portion of the side of the roller bearing raceway is removed allowing air in the passages between the rollers to be gathered by the cavity.

A slot is formed in the last machined surface of the journal arm connecting the cavity with the borehole for the purpose of venting air collected from the anti-friction bearings. Location of the groove is selected to be in the trailing edge of the journal arm, which is the edge which trails the journal arm as the bit is rotated in the borehole. Except for the region of the slot in the trailing edge, the cone mouth shoulder covers the entire last machined surface protecting the anti-friction bearings from incursion of cuttings and debris in the dome area of the bit where debris is known to pack and plug around the cone mouth shoulder The shirttail region of the bit is also protected by the narrow clearance between the cone mouth shoulder and last machined surface. Similarly, the leading edge of the journal arm is protected from cuttings and debris impinging upon the cone mouth shoulder. The life of the anti-friction bearings is improved by reducing the erosion of the bearings due to incursion of borehole cuttings and debris.

The manufacturing operations upon the last machined surface according to the present invention are relatively simple and inexpensive. No additional parts are required.

Accordingly, it is an object of this invention to provide a simple air vent for a rotating drill bit.

Another object of this invention is to provide an air vent which will not be plugged by borehole cuttings and other debris particularly in the dome area of the bit.

A further object of the invention is t provide an air vent which will gather sufficient air from the raceway of an anti-friction bearing and vented to the borehole thereby permitting the anti-friction bearing to be cooled without exposing the anti-friction bearing to the incursion of cuttings and other debris.

Still another object of the invention is to provide a maximum amount of protection for the anti-friction bearings around the circumference of the journal arm while venting the cooling air in the least vulnerable trailing edge of the journal arm.

BRIEF DESCRIPTION OF THE DRAWINGS

The foregoing and other objects, features and advantages of the invention will be apparent from the following more particular description of the preferred embodiment of the invention, as illustrated in the drawings.

DETAILED DESCRIPTION OF THE DRAWINGS

Figure 1:
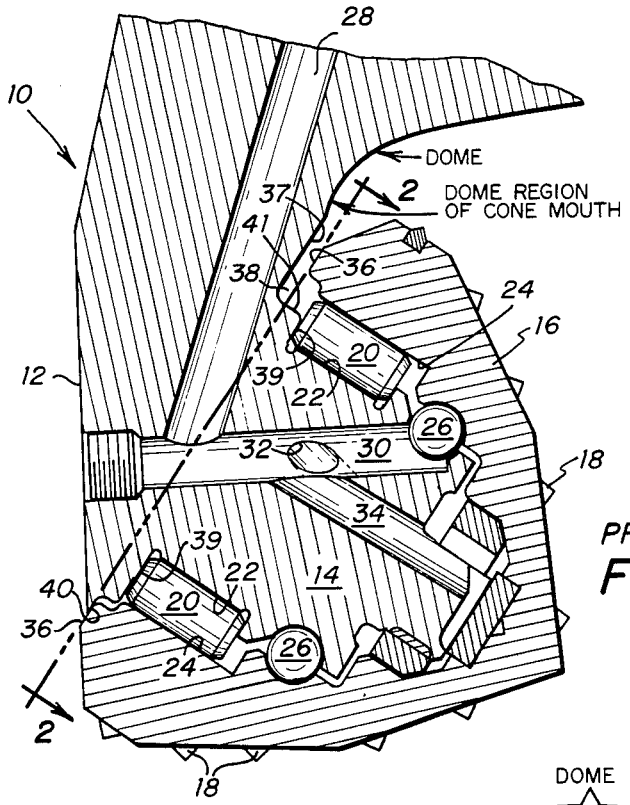
PRIOR ART FIG. 1
FIG. 1 is a partial cross-sectional view on line 1—1 of FIG. 2 of a portion of a drill bit illustrating the prior art.

FIG. 1 is a partial cross-sectional view of a portion of a prior art rotating drill bit 10 of a type primarily useful in the drilling of mining blast holes or geothermal wells into the earth. The bit 10 normally includes three depending legs 12, only one of which is shown in FIG. 1. Extending downwardly and radially from the lower end of the leg 12 is a generally cylindrical spindle or journal arm 14. A conically-shaped cutter 16 with suitable teeth 18 is mounted for rotatable motion on the journal arm 14. Roller bearings 20 are located in a race 22 cut into the journal arm 14. Another race 24 is cut into the cutter 16. Ball bearings 26 are also set in races formed in the journal arm 14 and cutter 16. The rollers 20 provide a roller bearing, or anti-friction bearing for supporting the load of the cutter 16 as it rotates around the journal arm 14 in response to rotation of the bit 10. Load is also taken up by the ball bearings 26 and by friction bearings in the interior nose of the cutter 16 illustrated diagrammatically in FIG. 1.

In order to cool the roller bearings 20, ball bearings 26 and friction bearings in the nose of cone 16, air is supplied through a conduit 28 in leg 12 and conduits 30, 32 and 34 in journal arm 14. The air penetrates through the passages between the ball bearings 26 and rollers 20 traveling in the direction of the cone mouth. This technique for cooling the bearings in a rock bit is described in more detail in my U.S. Pat. No. 4,688,651 issued Aug. 25, 1987 entitled, "Cone Mouth Debris Exclusion Shield."

In order to provide an escape for the air from the cutter 16 to the borehole in the earth produced by the rotating bit 10, a vent 38 is provided near the top of the journal arm 14. The vent 38 is formed between a shoulder 36 at the mouth of the cone 16, and a groove 37 cut into the journal arm 14. Also, a portion of a side 39 of raceway 22 is removed to form a window 41 into vent 38.

The air is not vented at the bottom of the journal arm 14 since the cone mouth shoulder 36 is shown to be in close contact with a surface 40 of the journal arm 14. The surface 40 of the journal arm 14 is commonly called the last machined surface of the journal arm 14 since it represents the last machining operation normally performed around the circumference of the journal arm 14 at the location where it is joined to the leg 12. The lower region of the leg 12 in the vicinity of the last machined surface 40 is commonly called the shirttail region of the bit 10. In this region of the journal arm 14, the cone mouth shoulder 36 is shown in FIG. 1 to be in very close proximity to the last machined surface 40 of the journal arm 14 with a very small clearance. The clearance is only a few thousandths of an inch in order to permit rotational movement of the cutter 16. Venting of air around the cone mouth shoulder 36 at the bottom of the journal arm 14 is substantially inhibited. Accordingly, venting of the air out to the borehole is accomplished primarily through vent 38.

Figure 2:
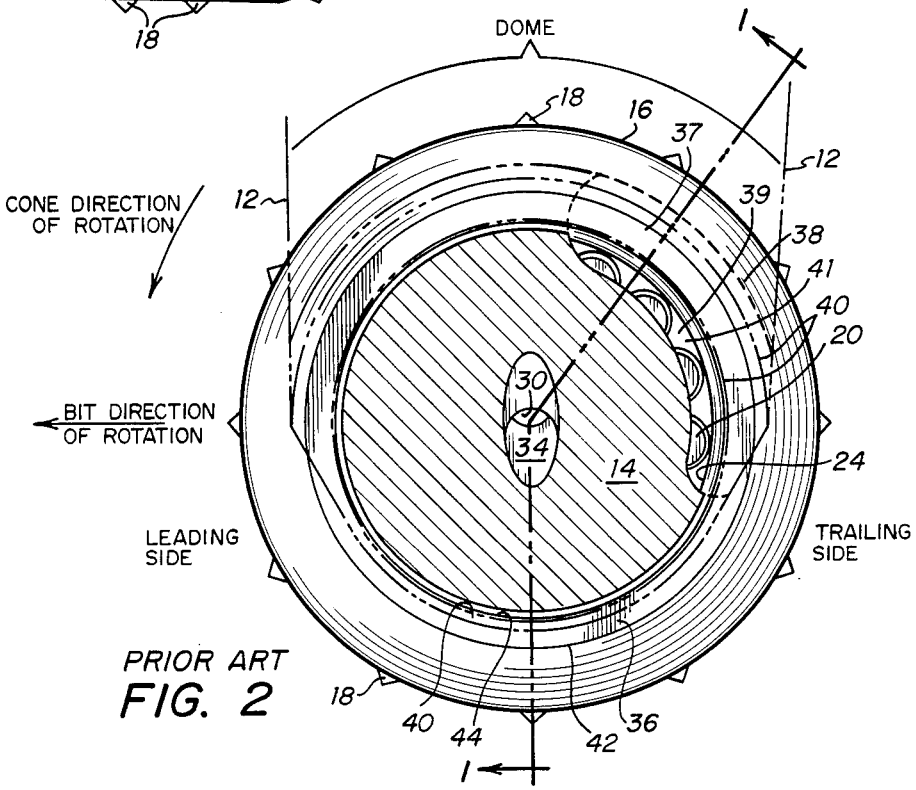
PRIOR ART FIG. 2
FIG. 2 is a cross-sectional view on the line 2—2 of FIG. 1.

In order to illustrate the vent 38 in greater detail, FIG. 2 is shown as a cross-sectional view on the line 2—2 of FIG. 1. Like numbers are used in both FIGS. 1 and 2. Also, the partial cross-sectional view in FIG. 1 is taken along the broken line 1—1 in FIG. 2. The last machined surface 40 is shown in FIG. 2 in cross-hatched form so that this surface can be distinguished from other surfaces illustrated in FIG. 2. The last machined surface 40 is narrower in the bottom region of the journal arm 14, or shirttail region of the bit 10, and is wider in the upper region of the journal arm 14, sometimes called the dome area of the bit 10. The roller bearings 20 are illustrated in FIG. 2 in between the raceway 24 of the cutter 16 and the raceway 22 of the journal arm 14. The cone mouth shoulder 36 is illustrated as the surface between circular lines 42 and 44. As can be seen from FIG. 2, the cone mouth shoulder 36 therefore overlaps and covers the last machined surface 40 around the complete circumference of the journal arm 14 except for the region of the air vent 38. Vent 38 in FIG. 2 is formed by cutting the groove 37 into the last machined surface 40 in the area of the upper right quardrant of FIG. 2. The area of vent 38 occupies a quadrant of approximately 90° of the circumference of journal bearing arm 14. It allows air to escape to the borehole throughout the entire 90° quadrant. Due to the removal of the side 39 of the raceway 22 and cutting of groove 37 in the last machined surface 40, the air passageways between five of the roller bearings 20 are directly exposed to the vent 38 through the window 41.

In addition to the venting of air from vent 38, it is possible for cuttings and debris accumulating in the dome of the bit 10 to drop into the vent 3 due to gravitational forces. This debris is known to infiltrate the passages between the roller bearings 20 and cause abrasion of the raceways 22 and 24, as well as deterioration of other bearing surfaces on the journal arm 14 and cutter 16. Thus, the useful life of the bit 10 is diminished.

Figure 3:
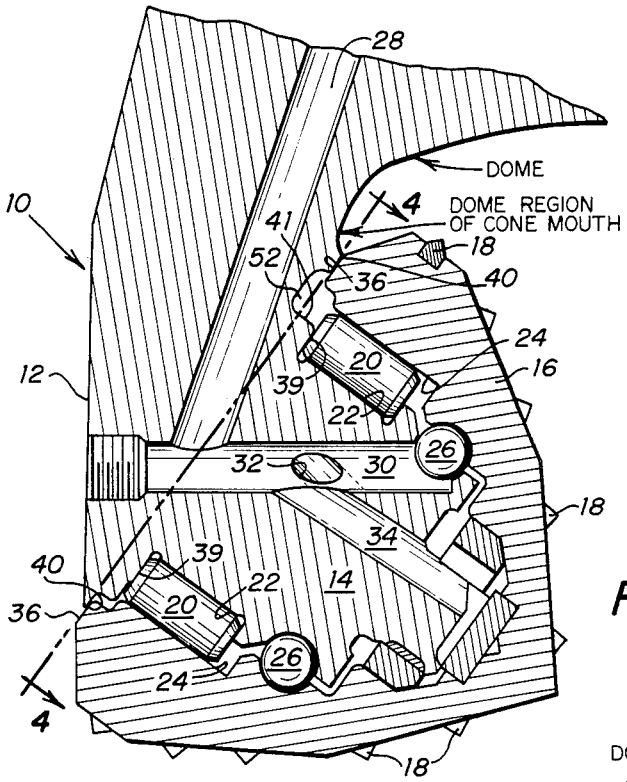
FIG. 3 is a partial cross-sectional view on the line 3—3 of FIG. 4 of a portion of a drill bit illustrating the present invention.
Figure 4:
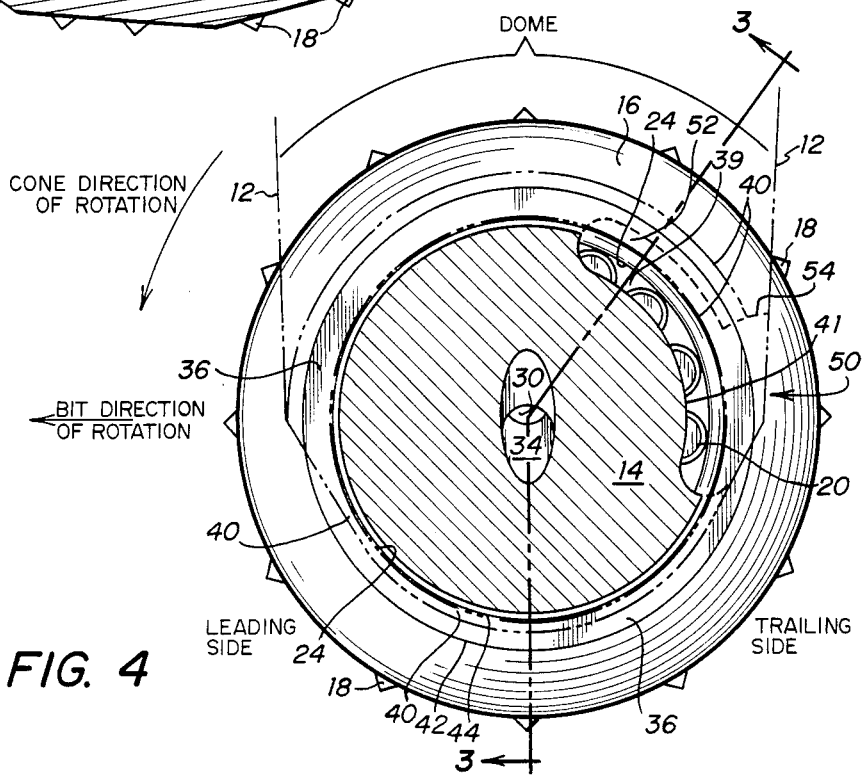
FIG. 4 is a cross-sectional view on the line 4—4 of FIG. 3.

FIGS. 3 and 4 illustrate the present invention which permits venting of air while minimizing the incursion of cuttings and debris from the dome area of the bit. FIGS. 3 and 4 utilize the same numbers used in FIGS. 1 and 2 wherever the elements designated are similar. The partial cross-sectional view in FIG. 3 is taken along the broken line 3—3 in FIG. 4, and the cross-sectional view in FIG. 4 is taken along line 4—4 in FIG. 3. The general operation of the rotational component parts of the bit 10 described above with respect to FIGS. 1 and 2 is the same as the rotational operation of the components in bit 10 in FIGS. 3 and 4. The primary focus of the following description is in connection with a novel vent designated 50 in FIG. 4.

Referring to FIG. 3 in the shirttail or lower portion of the leg 12 and journal arm 14, the clearance between cone mouth shoulder 36 and last machined surface 40 is small in the order of a few thousandths of an inch. Accordingly, air in the passages between roller bearings 20 is blocked from escaping into the borehole through this region. Similarly, in the upper or dome region of the bit, the clearance between the cone mouth shoulder 36 and last machined surface 40 is in the order of a few thousandths of an inch and air is blocked from escaping to the borehole in this region A cavity 52 is formed in the journal arm 14 for the purpose of collecting air from the passages between rollers 20. This cavity is illustrated in more detail in FIG. 4. The cavity 52 is formed by cutting away a semi-arcuate portion of the last machined surface 40 and the side 39 of raceway 22 in the journal arm 14 to form the window 41. Air is collected from five passageways between the rollers 20 by the cavity 52. The cavity 52 extends approximately 90° around the circumference of the journal arm 14. The air is exhausted from the cavity 52 by means of a slot 54 which is formed by cutting away the outer periphery of the last machined surface 40 in the region of the cavity 52 The slot 54 extends over about 45° of the circumference of the journal arm 14. Therefore, as shown in FIG. 4, the lower half of the cavity 52 is vented to the borehole while the upper half of the cavity 52 is sealed off from the borehole by reason of the very small clearance between the last mentioned machine surface 40 and the cone mouth shoulder 36. The location of the slot 54 is selected to be on the portion of the journal arm 14 known as the trailing edge. This portion is known as the trailing edge because the leg 12 travels around the outer perimeter of the borehole causing one side of the journal arm 14 to trail behind. In the illustration shown in FIG. 4, the right side of the journal arm 14 is the trailing edge, while the left side is the leading edge. Borehole cuttings and other debris swirling in the borehole as the bit 10 rotates around the axis of the borehole, and the cutter 16 rotates about the journal arm 14, will impinge upon the leading edge of the cone mouth shoulder 36. The clearance between the leading edge of the cutter mouth shoulder 36 and the last machined surface 40 is very narrow so that the borehole cuttings and other debris are less likely to gain entry through this region into the roller bearing raceways 22 and 24. On the other hand, the trailing edge of the journal arm 14 where slot 54 vents the air, experiences considerably less impact from the borehole cuttings and other debris. Accordingly, experience in running bits of this novel design has demonstrated less incursion of borehole cuttings and other debris into the roller bearing raceways 22 and 24.

Another vulnerable portion of the bit 10 to incursion of borehole cuttings and other debris into the raceways 22 and 24 occurs in the dome or upper region of the journal arm 14 where cuttings and debris tend to pack and plug up any air vents. This results in the blockage of cooling air and incursion of debris into the raceways 22 and 24. In the novel vent design illustrated in FIG. 4, the dome or upper region of the journal arm is protected by the very narrow clearance between the cutter con shoulder 36 and the last machined surface 40 of the journal arm 14.

Another vulnerable region of the bit 10 is the lower or shirttail region of the bit which rotates around the outer periphery of the borehole in close proximity to the abrasive wall of the borehole. According to the design of the vent 50 as shown in FIG. 4, the very narrow clearance between cone mouth shoulder 36 and last machined surface 40 is maintained throughout the lower shirttail region minimizing the incursion of borehole cuttings and other debris into the raceways 22 and 24. According to the design of novel vent 50, the cone mouth shoulder 36 completely covers the roller bearings 20, and, except in the trailing edge region where slot 54 vents cavity 52, cone mouth shoulder 36 matches with the last machined surface 40 to form a clearance adequate for rotational movement, but blocks the venting of air and incursion of cuttings and debris into the raceways 22 and 24. All of these features and advantages are accomplished by simple machining operations on the last machined surface 40 and the side 39 of raceway 22. No additional parts need be added to conventional rotary bits.

Although the present invention has been described with respect to a specific preferred embodiment thereof, various changes and modifications may be suggested to one skilled in the art and it is intended that the present invention encompass such changes and modifications as fall within the scope of the appended claims.

What is claimed is:

1. In a rotating bit for drilling a borehole in the earth having at least one journal arm, a cutter cone mounted for rotational movement on said journal arm, gaseous fluid conducting means in said bit and journal arm for conducting gaseous fluid out of said journal arm under said cutter cone, bearing means located between said cutter and journal arm and in the path of said gaseous fluid for permitting rotational movement of said cutter on said journal arm with a narrow clearance therebetween adequate for such rotational movement and small enough to substantially block said fluid from venting out from under the cutter cone into the borehole, the improvement comprising in combination:

a cavity formed in said journal arm and positioned to collect and in fluid communication with said gaseous fluid after traveling through said bearing means without enlarging said clearance between said cutter and said journal arm; and, a slot formed in said journal arm connecting said cavity to the borehole and located in the trailing edge of said journal arm as said bit rotates, thereby venting said gaseous fluid collected in said cavity to the borehole at the trailing edge of said journal arm.

2. The improved bit of claim 1 wherein said cutter is shaped in the form of a cone with a shoulder at the mouth of the cone, and said journal arm includes a last machined surface at the circumference of the journal arm which is sized to match with said cone mouth shoulder to form said narrow clearance therebetween, and said cavity is formed in said last machined surface in a semi-arcuate shape having a width selected so that said cone mouth shoulder covers said cavity, and said slot is formed in the outer periphery of said last machined surface in connection with said cavity to vent gaseous fluid collected in said cavity to the borehole at the trailing edge of said journal arm.

3. The improved bit of claim 2 wherein said bearing means includes rollers with passages therebetween conducting gaseous fluid therethrough, and said semi-arcuate cavity is positioned to collect said gaseous fluid from a plurality of passages between said rollers.

4. The improved bit of claim 3 wherein said semi-arcuate cavity is located in the dome region of said bit near the top of said journal arm.

5. The improved bit of claim 4 wherein said rollers are mounted for rotational movement in a raceway formed in said journal arm, said raceway having a side thereto adjacent to said last machined surface, and said semi-arcuate cavity including a window formed by removing a portion of said side of said raceway to collect gaseous fluid flowing in the passageways between said rollers.

6. In a rotating bit for drilling a borehole in the earth having at least one depending leg, a downwardly and radially projecting journal arm, a cutter cone mounted on said journal arm, roller bearing means located between said cutter and journal arm for permitting rotational movement of said cutter, and gaseous fluid conducting means in said body and arm for conducting fluid to said roller bearing means thereby cooling said bearing means, said journal arm having a last machined circumferential surface located between said leg and said roller bearing means, said cutter shaped in the form of a cone with an open mouth having a circumferential shoulder sized to match with said last machined surface, said cutter being mounted on said journal arm so that a clearance is established between said cone shoulder and said last machined surface, said clearance being adequate to permit unobstructed rotational movement of said cutter on said journal arm, and said clearance being narrow enough to substantially block fluid from said roller bearing means venting to said borehole, the improvement comprising in combination:

a semi-arcuate cavity formed in said last machined surface of said journal arm and generally located in the upper portion of said arm, the width of said cavity being selected so that said cavity opens onto said roller bearing means thereby allowing said fluid flowing through said bearing means to be collected in said groove, and so that said cavity is substantially covered by said shoulder of said cone mouth; and, a slot formed in said last machined surface of said journal arm and generally located in the trailing edge of said journal arm as the body of said bit rotates said arm in the borehole, said slot extending from the outer circumferential edge of said last machined surface to said groove thereby venting the fluid collected in said groove to the borehole, the position and depth of the cut of said slot into said last machined surface being selected to allow adequate venting of fluid to cool said bearing and to minimize incursion of cuttings from said borehole into said bearing means.

7. The improved bit of claim 6 wherein said roller bearing means includes rollers with passages therebetween conducting gaseous fluid therethrough, and said semi-arcuate cavity is positioned to collect said gaseous fluid from a plurality of passages between said rollers.

8. The improved bit of claim 7 wherein said semi-arcuate cavity is located in the dome region of said bit near the top of said journal arm.

9. The improved bit of claim 8 wherein said rollers are mounted for rotational movement in a raceway formed in said journal arm, said raceway having a side thereto adjacent to said last machined surface, and said semi-arcuate cavity including a window formed by removing a portion of said side of said raceway to collect gaseous fluid flowing in the passageways between said rollers.

* * * * *